US006340257B1

(12) United States Patent
Chia-Yi et al.

(10) Patent No.: US 6,340,257 B1
(45) Date of Patent: Jan. 22, 2002

(54) CLEAN DETERGENT PROVIDING DEVICE FOR CLEANING TOOLS

(76) Inventors: Hsieh Chia-Yi, No. 357-2, Chung Hua Road, Wu-Chi Town, Taichung Hsien; Chen He-Jin, No. 17, Alley 33, Lane 24, Sec 3, Chung Yang Road, Lung-Ching Hsiang, Taichung Hsien, both of (TW)

( * ) Notice: Subject to any disclaimer, the term of this patent is extended or adjusted under 35 U.S.C. 154(b) by 0 days.

(21) Appl. No.: 09/829,926

(22) Filed: Apr. 11, 2001

(51) Int. Cl.[7] ..... A47L 13/22

(52) U.S. Cl. ..... 401/42; 222/145.1; 222/630; 401/138; 401/140; 401/172; 401/180; 401/277

(58) Field of Search ..... 401/40–42, 118, 401/119, 137–140, 172, 176, 180, 270, 277; 222/145.1, 630

(56) References Cited

U.S. PATENT DOCUMENTS 3,225,759 A * 12/1965 Drapen et al. ..... 401/40 X
4,126,401 A * 11/1978 Stoyshin ..... 401/42
4,575,270 A * 3/1986 Hammond ..... 401/40
5,725,322 A * 3/1998 Evans ..... 401/42
5,988,911 A * 11/1999 Browne, Jr. et al. ..... 401/42
6,116,798 A * 9/2000 Chen et al. ..... 401/42

* cited by examiner

*Primary Examiner*—David J. Walczak
*Assistant Examiner*—Kathleen J. Prunner
(74) *Attorney, Agent, or Firm*—Bacon & Thomas, PLLC

(57) ABSTRACT

A clean detergent device includes a tube for connecting with a mophead and a tank containing the clean detergent attached to the tube. A first aperture is defined radially through the tube and communicates with the tank in which a piston is movably received. A second aperture is defined in communication with the tank and the tube. A connection member extends through the tank and a valve is received in the connection member. A hole is defined through the connection member and communicates with the tank. The valve controls the hole to allow detergent to flow into the tube via the second aperture.

4 Claims, 5 Drawing Sheets

CLEAN DETERGENT PROVIDING DEVICE FOR CLEANING TOOLS

FIELD OF THE INVENTION

The present invention relates to a clean detergent providing device which is attached to a shaft of a cleaning tool and has a valve to control the amount of the detergent entering into the shaft in which water stream flows.

BACKGROUND OF THE INVENTION

A conventional cleaning tool such as a mop generally includes a shank with a handle and a mophead. A squeeze means is connected to the shank and is able to squeeze the mop. The latest mop has a passage defined in the shank so that the shank can be connected with a hose to send water to the mop via the passage. A tank for receiving clean detergent is attached to the shank and a switch is controlled by the user to spray the detergent to the floor so that the mop may clean the position of the floor with the detergent mixed with water on the floor. The detergent cannot be mixed with the water before it contacts the floor and the detergent could attached on an outside of the mop and/or the shank because the detergent is injected by a rough way.

SUMMARY OF THE INVENTION

In accordance with one aspect of the present invention, there is provided a clean detergent providing device for a cleaning tool which comprises a tube for connecting with a handle and a mophead of the cleaning tool. A first aperture and a second aperture are respectively defined radially through the tube. A tank is connected to the tube with a first connection member and a second connection member connected therebetween. The first connection member communicates with the first aperture and an interior of the tank. The second connection member communicates with the second aperture and extends through a first end of the tank. A hole is defined through the second connection member and located in the tank. A valve is movably received in the second connection member and movably seals the second aperture and the hole. A piston is movably received in the tank and a spring is biased between and end plate and the piston. A cap is connected to a second end of the tank and retains the piston. The first connection member communicates with a space between the cap and the piston.

The primary object of the present invention is to provide a clean detergent providing device wherein the detergent enters in the tube of the cleaning tool and mixes with the water before contacting the ground or floor.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
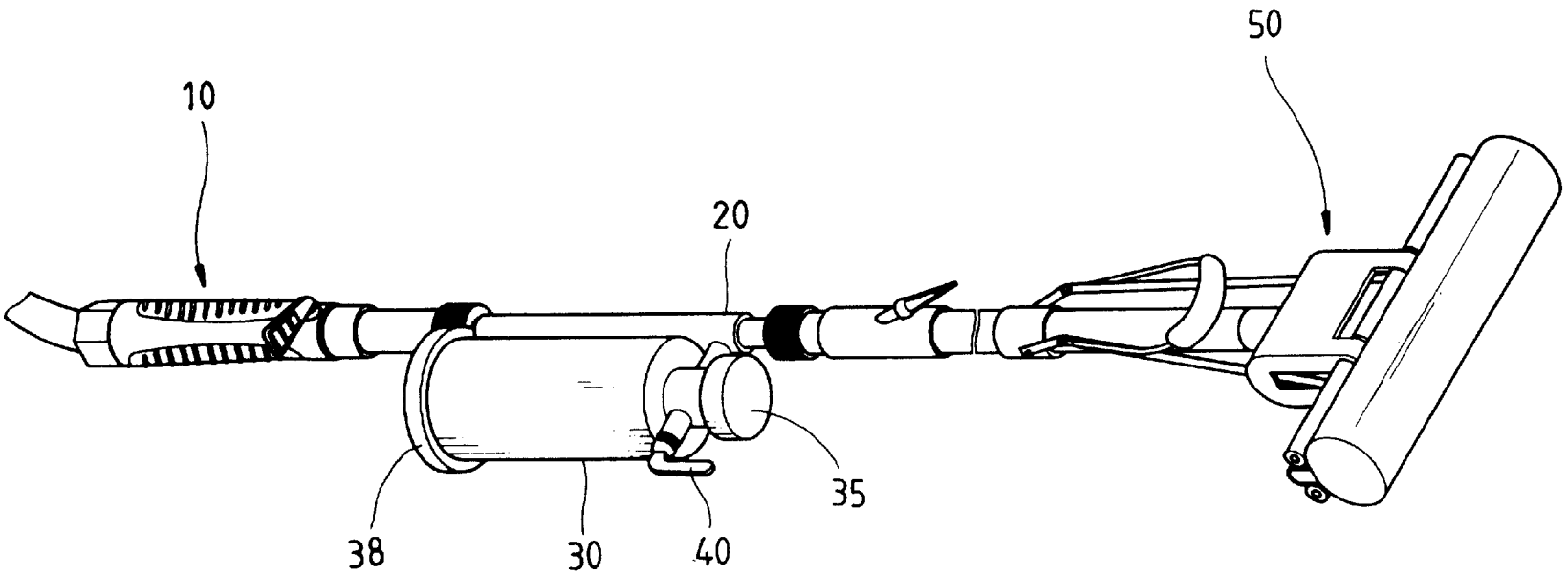
FIG. 1 is a perspective view to show a mop with the clean detergent providing device of the present invention.
Figure 2:
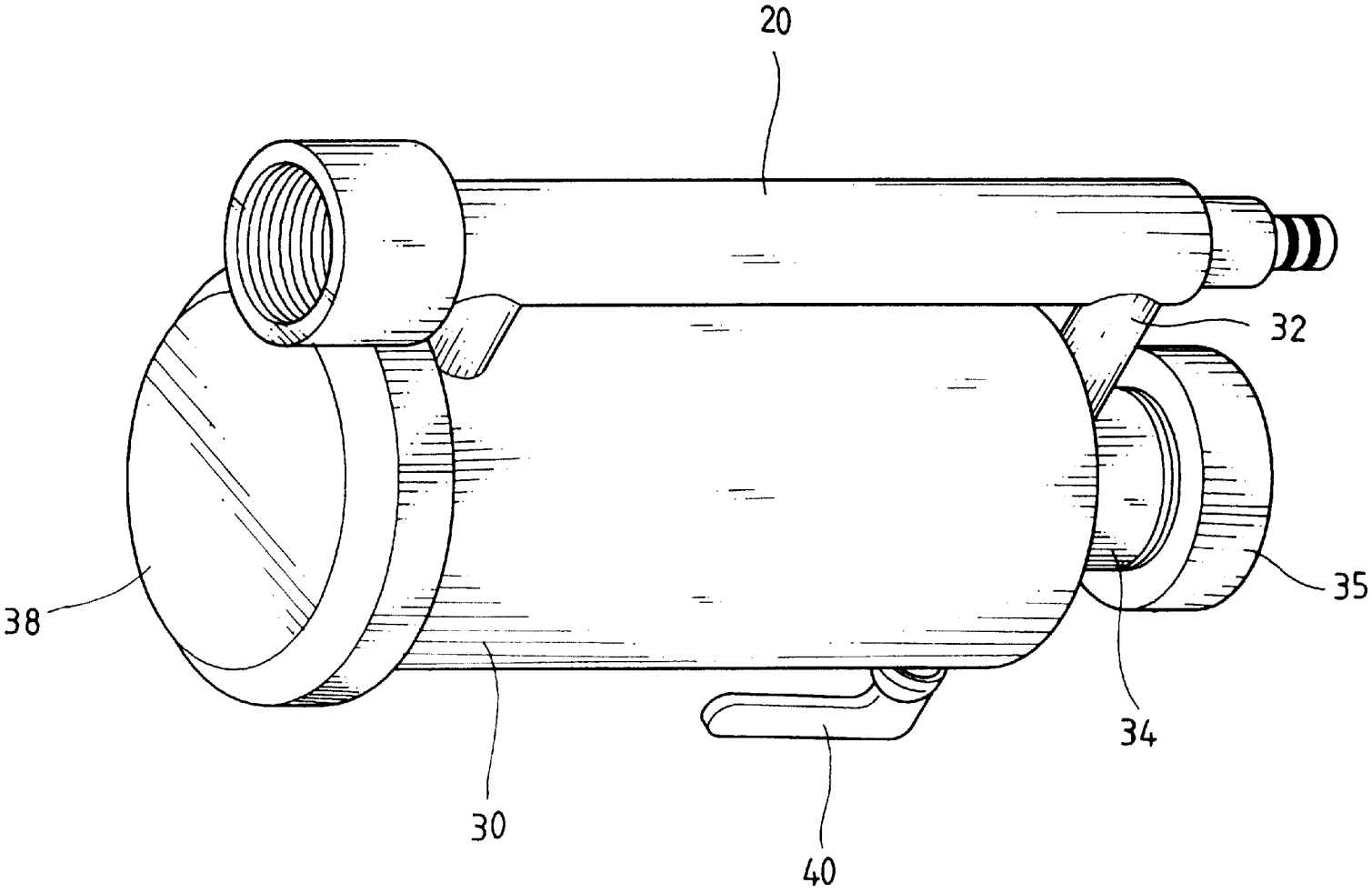
FIG. 2 is a perspective view to show the clean detergent providing device of the present invention.
Figure 3:
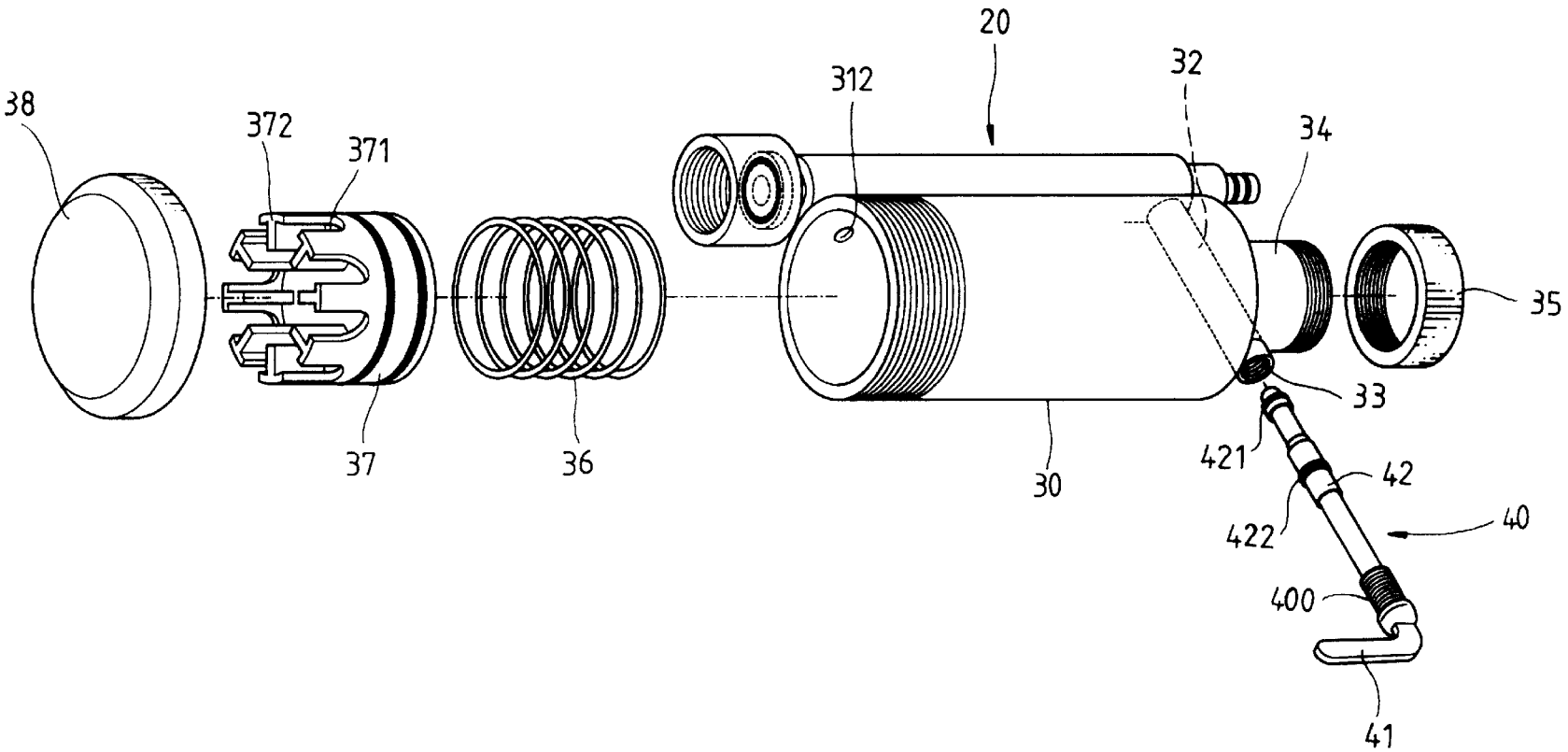
FIG. 3 is an exploded view to show the clean detergent providing device of the present invention.
Figure 4:
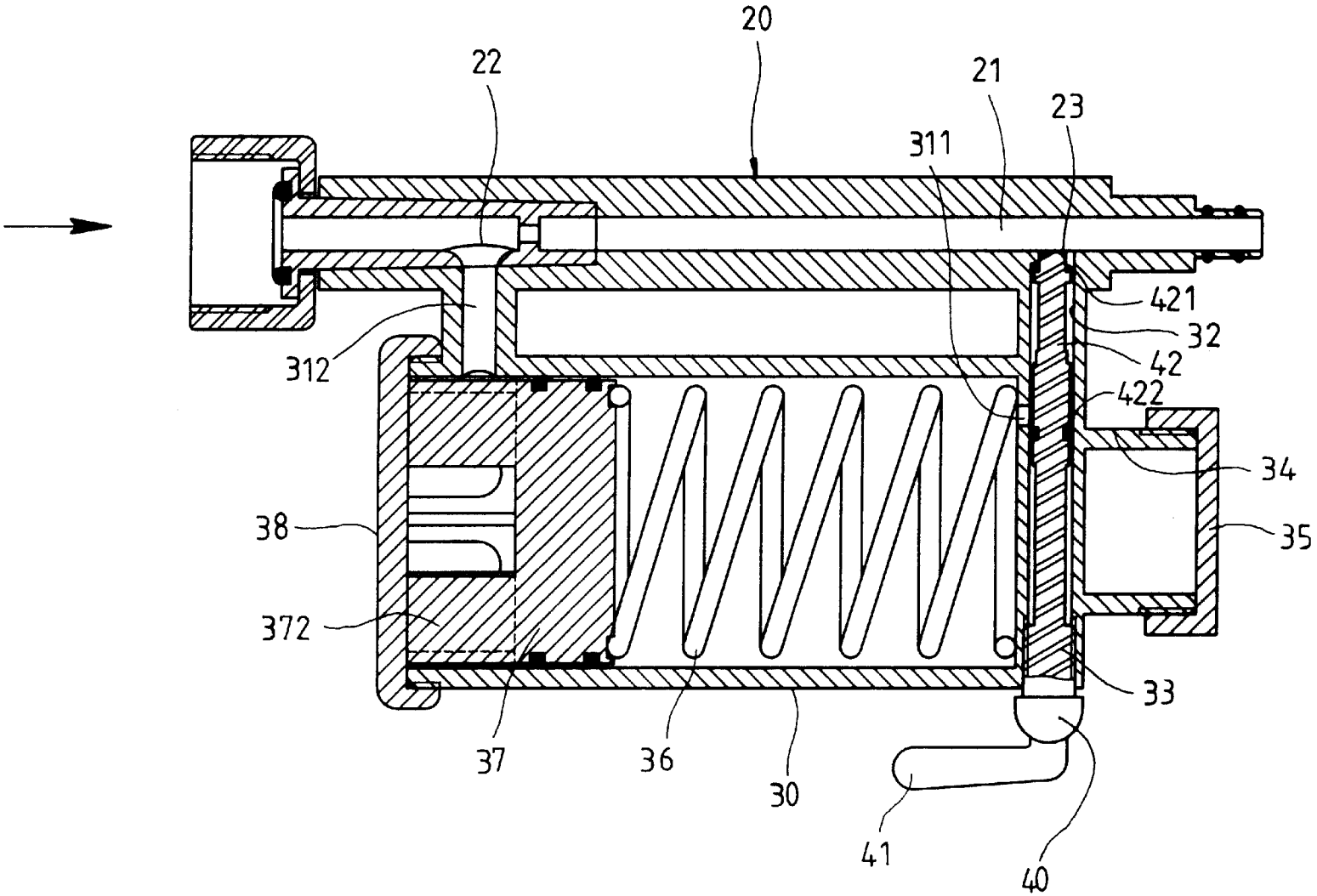
FIG. 4 is a cross sectional view to show the clean detergent providing device of the present invention.

Referring to FIGS. 1 to 4, the clean detergent providing device of the present invention comprises a tube 20 having a first end thereof connected to a handle 10 of the cleaning tool, a mop for example, and a second end of the tube 20 is connected to a mophead 50. The tube 20 has a passage 21 defined therethrough so that water is entered from the handle 10 and flows through the tube 20 to the mophead 50. A first aperture 22 and a second aperture 23 are respectively defined radially through the tube 20.

A tank 30 for receiving clean detergent is connected to the tube 20 with a first connection member 312 and a second connection member 32 connected between the tank 30 and the tube 20. The first connection member 312 communicates with the first aperture 22 and an interior of the tank 30. The second connection member 32 communicates with the second aperture 23 and is in a form of a tubular member which extends through a first end of the tank 30 radially and has a threaded inner periphery 33 defined in an end of the tubular member and located opposite to the tube 20. A hole 311 is defined radially through the tube of the second connection 32 so that the clean detergent in the tank 30 may flow into the second connection member 32 via the hole 311. A valve 40 is movably received in the second connection member 32 and movably seals the second aperture 23 and the hole 311. An inlet portion 34 extends from the first end of the tank 30 and a cover 35 seals the inlet portion 34. The inlet portion 34 communicates with the interior of the tank 30 so that the clean detergent can be added into the tank 30 via the inlet portion 34 easily. A piston 37 is movably received in the tank 30 and a spring 36 is biased between the tube of the second connection member 32 and the piston 37. A cap 38 is connected to a second end of the tank 30 and retains the piston 37. The first connection member 312 communicates with a space between the cap 38 and the piston 37. The piston 37 has spikes 372 extending from an end thereof and gaps 371 are defined between the spikes 372. The gaps 371 communicate with the first connection member 312 so that when the water flows into the space via the first connection member 312, the piston 37 is pushed toward the second connection member 32 to force the clean detergent in the tank 30 to flow into the second connection member 32 via the hole 311.

The valve 40 includes a rod which has a threaded section 400 which is engaged with the threaded inner periphery 33. A lever 41 extends from a first end of the rod of the valve 40 and has a large section 42 and an enlarged second end. Two seals 421, 422 are respectively mounted to the enlarged second end and the large section 42. The seal 421 seals the second aperture 23 and the seal 422 seals the second connection member 32 so that the clean detergent will not leak from the first end of the valve 40.

Figure 5:
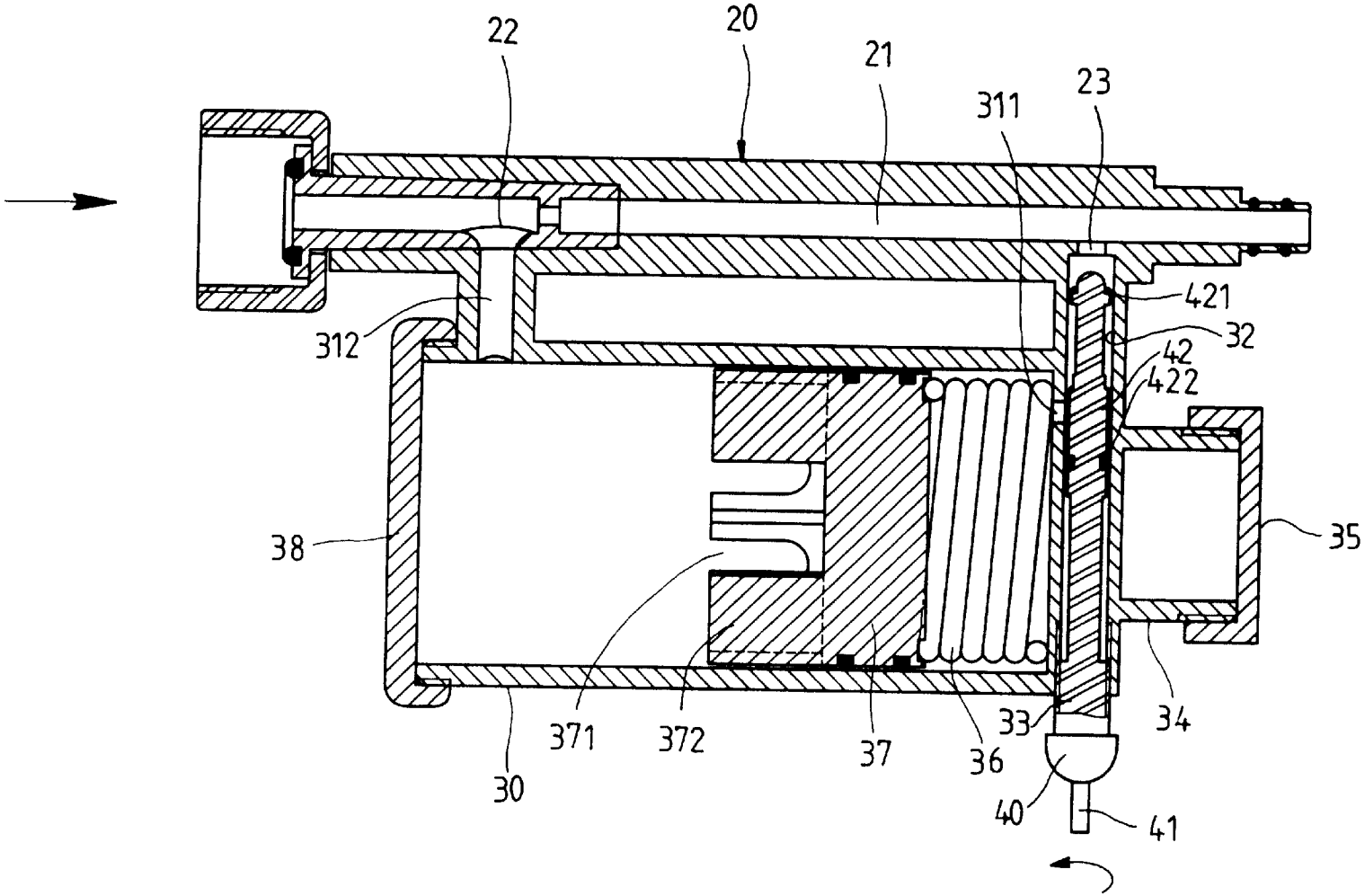
FIG. 5 is a cross sectional view to show the piston pushed to release detergent when operating the valve.

As shown in FIG. 5, when rotating the lever 41, the rod of the valve 40 is moved away from the tube 20, and the second aperture 23 is opened and the hole 311 communicates with an annular space of the rod between the enlarged second end and the large section 42. Water flows in the space between the piston 37 and the cap 38 via the first connection member 312 to push the piston 37 to compress the clean detergent in the tank 30 into the annular space in the second connection member 32 via the hole 311. The clean detergent is then mixed with the water at the second aperture 23 and flows to the mophead 50. When re-rotating the lever 41, the hole 311 is sealed again, the piston 37 is pushed back by the spring 36.

By the device of the present invention, the user may mix the clean detergent with the water before the mophead 50.

While we have shown and described the embodiments in accordance with the present invention, it should be clear to those skilled in the art that further embodiments may be made without departing from the scope of the present invention.

What is claimed is:

1. A clean detergent providing device for a cleaning tool, comprising:

a tube having a first end thereof adapted to be connected to a handle of the cleaning tool, and a second end of said tube adapted to be connected to a mophead, a first aperture and a second aperture respectively defined radially through said tube, and a tank connected to said tube with a first connection member and a second connection member connected between said tank and said tube, said first connection member communicating with said first aperture and an interior of said tank, said second connection member communicating with said second aperture and extending radially through a first end of said tank, a hole defined through said second connection member and communicating with said tank and said second connection member, a valve movably received in said second connection member and movably sealing said second aperture and said hole, a piston movably received in said tank and a spring biased between an end plate and said piston, a cap connected to a second end of said tank and retaining said piston, said first connection member communicating with a space between said cap and said piston.

2. The device as claimed in claim 1, wherein said piston has spikes extending from an end thereof and gaps are defined between said spikes, said gaps communicating with said first connection member.

3. The device as claimed in claim 1, wherein said valve includes a threaded section and said second connection member has a threaded inner periphery which is engaged with said threaded section.

4. The device as claimed in claim 1 further comprising an inlet portion extending from said first end of said tank and a cover sealing said inlet portion, said inlet portion communicating with said interior of said tank.

* * * * *